United States Patent [19]

Hall

[11] 4,350,340

[45] Sep. 21, 1982

[54] ELECTRONIC LOGIC GAME METHOD AND APPARATUS

[75] Inventor: Alfred E. Hall, Dallas, Tex.

[73] Assignee: Sigalos & Levine, P.C., Dallas, Tex.

[21] Appl. No.: 190,612

[22] Filed: Sep. 25, 1980

[51] Int. Cl.[3] ..... A63F 9/06

[52] U.S. Cl. ..... 273/153 R; 273/1 E; 273/138 A

[58] Field of Search ..... 273/153 R, 1 E, 138 A, 273/237, 238, 856, 1 GC, 1 GH

[56] References Cited

U.S. PATENT DOCUMENTS

| | | | |
|---|---|---|---|
| 4,014,550 | 3/1977 | Wilcox | 273/153 R |
| 4,059,272 | 11/1977 | Pullman | 273/237 |
| 4,244,635 | 1/1981 | Sasaki et al. | 273/237 |

OTHER PUBLICATIONS

Richard Dudley, "*Tug 'O' War Game*", Apr. 1977, pp. 1029–1034.

*Primary Examiner*—Vance Y. Hum
*Assistant Examiner*—Leo P. Picard
*Attorney, Agent, or Firm*—Sigalos & Levine

[57] ABSTRACT

An electronic logic game method and apparatus comprising a device for simulating a balance scale in its balanced state or either of its unbalanced states, a device for simulating playing pieces one of which is simulated to be heavier or lighter than the others and selected ones of which may be symbolically placed on said simulated balance scale, and a device coupled to said simulated balance scale for detecting the presence or absence of the simulated heavier or lighter playing piece and simulating the scale to be balanced or unbalanced in a predetermined direction according to the presence or absence of the piece whereby the heavier or lighter piece may be logically discovered in a predetermined number of electronic scale balance or unbalance representations.

11 Claims, 15 Drawing Figures

ELECTRONIC LOGIC GAME METHOD AND APPARATUS

BACKGROUND OF THE INVENTION

The present invention relates to an electronic game and in particular to an electronic logic game wherein a plurality of playing pieces, one of which is different than the others, and a balance scale may be utilized in a predetermined number of measurements to discover the different playing piece.

A logic game that is old and well-known in the art concerns a plurality of playing pieces such as marbles one of which is heavier or lighter than the others. It is possible, by utilizing a balance scale to "weigh" various combinations of the marbles at three different times and by observing the direction in which the scale is unbalanced or whether the scale is balanced, to determine which of the marbles is the odd one and whether or not it is heavier or lighter than the others.

Such measurements are generally made mentally inasmuch as a plurality of marbles do not exist wherein one of them differs from the others by being heavier or lighter than the others. Secondly, if such plurality of marbles existed, the difference in weight of the odd marble would have to be so slight that it could not be detected simply by comparing one marble with each of the others sequentially by "feeling" the weight thereof. If such marbles did exist where one could not determine the odd marble simply by "feeling" the weight of one with respect to another, then a precision type balance scale would be required in order to solve the logic puzzle.

Thus, while the logic problem is challenging and unique, it must be performed mentally or with the use of diagrams hand drawn on a sheet of paper in order for the puzzle to be solved.

Thus, it is an object of the present invention to provide an electronic logic game which utilizes a simulated electronic balance scale and simulated playing pieces.

It is also an object of the present invention to utilize a plurality of playing pieces wherein one of the playing pieces is simulated to be heavier or lighter than the others.

It is still another object of the present invention to provide an electronic logic game utilizing a simulated balance scale having a plurality of indicia thereon such as lights to indicate whether or not said scale is balanced or unbalanced and, if unbalanced, the direction of unbalance.

It is also an object of the present invention to provide an electronic logic game having a plurality of simulated playing pieces, each of which has a specific number assigned thereto for a particular game and wherein the number assigned thereto is detachably fastened to the playing piece wherein the number can be changed for each game thus preventing the different marble made from being known once it has been found.

It is still another object of the present invention to provide a hand held electronic logic game having a liquid crystal display whereon a simulated balance scale may be depicted in its balanced or unbalanced state.

It is still a further object of the present invention to provide a hand held logic game having a memory, a display, and a keyboard wherein data representing a plurality of simulated playing pieces may be stored in memory, one of said plurality of playing pieces being designated from said keyboard as heavier or lighter than the others, and selected ones of said playing pieces being symbolically placed on a balance scale represented on said display and the selected ones placed on said scale compared with the one of said playing pieces designated to be heavier or lighter than the others whereby the balance scale representation may indicate if said scale is balanced or unbalanced in a particular direction because of the selected playing pieces placed thereon.

SUMMARY OF THE INVENTION

Thus, the present invention relates to an electronic logic game comprising means for simulating a balance scale in its balanced state or either of its unbalanced states, a plurality of simulated playing pieces one of which is simulated to be heavier or lighter than the others and selected ones of which may be symbolically placed on said simulated balance scale, and means coupled to said balance scale for detecting the presence or absence of said simulated heavier or lighter playing piece and simulating said scale to be balanced or unbalanced in a predetermined direction according to the presence or absence of said piece whereby said piece may be logically discovered in a predetermined number of said electronic scale balance or unbalance representations.

The present invention also relates to a method of solving a logic problem comprising the steps of simulating a scale which may be balanced or unbalanced in either direction, designating one of a plurality of playing pieces to be heavier or lighter than the others, placing a combination of selected ones of said plurality of playing pieces on said simulated scale to cause an indication of balance or unbalance of said simulated scale and the direction of unbalance and observing said balance or unbalance in different combinations of said playing pieces are placed on said scale three successive times whereby said playing piece and its heavier or lighter designated weight may be discovered.

BRIEF DESCRIPTION OF THE DRAWINGS

These and other more detailed and specific objectives will be disclosed in the course of the following specification reference being had to the accompanying drawings in which.

Figure 1:
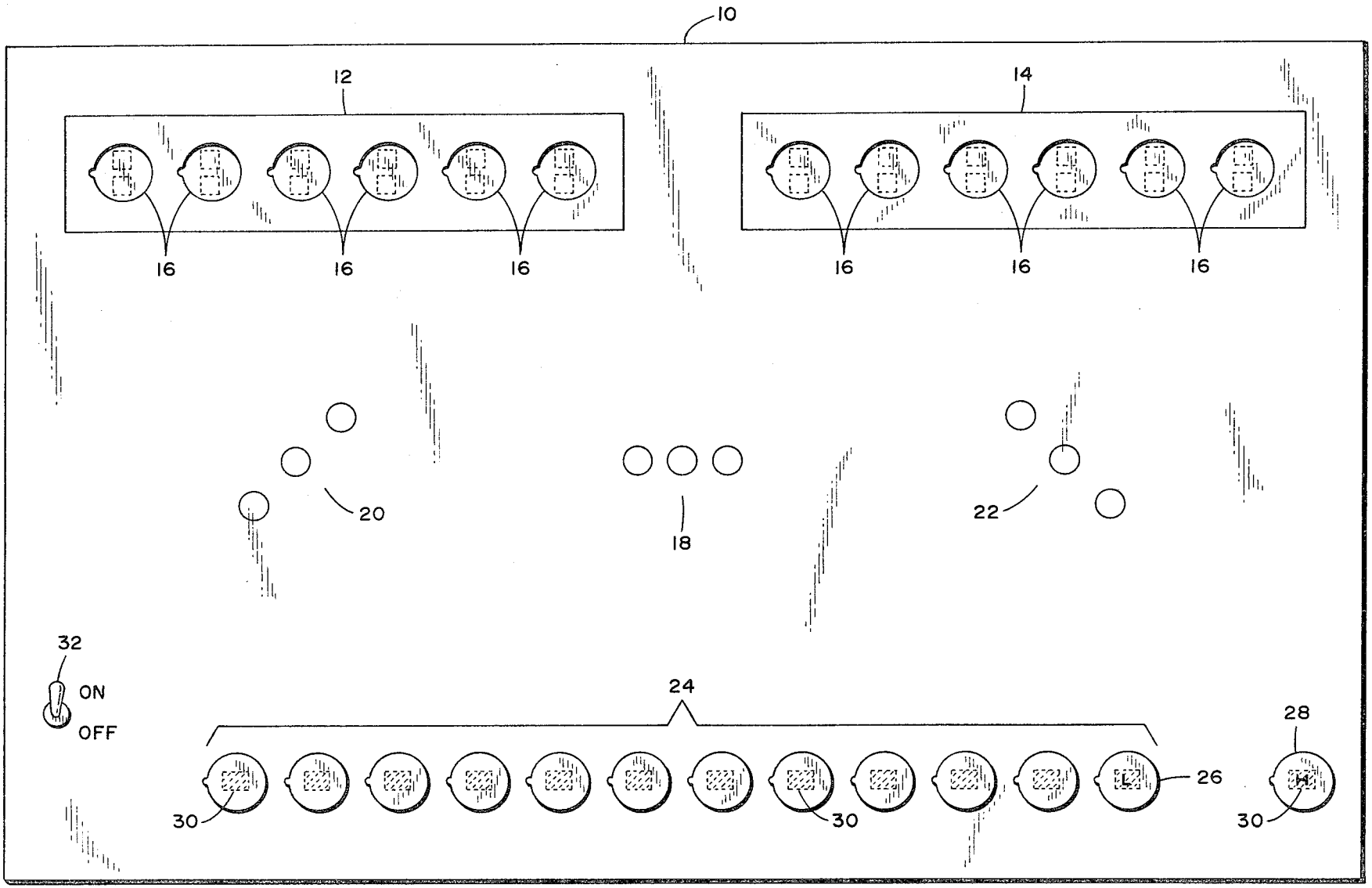
FIG. 1 is a diagrammatic representation of the front of a simulated electronic balance scale.
Figure 3:
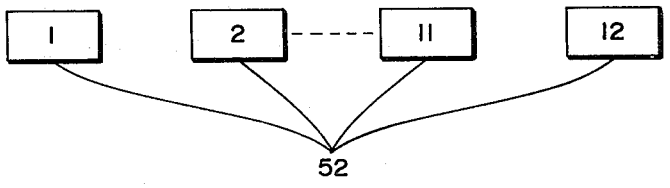
Figure 4:
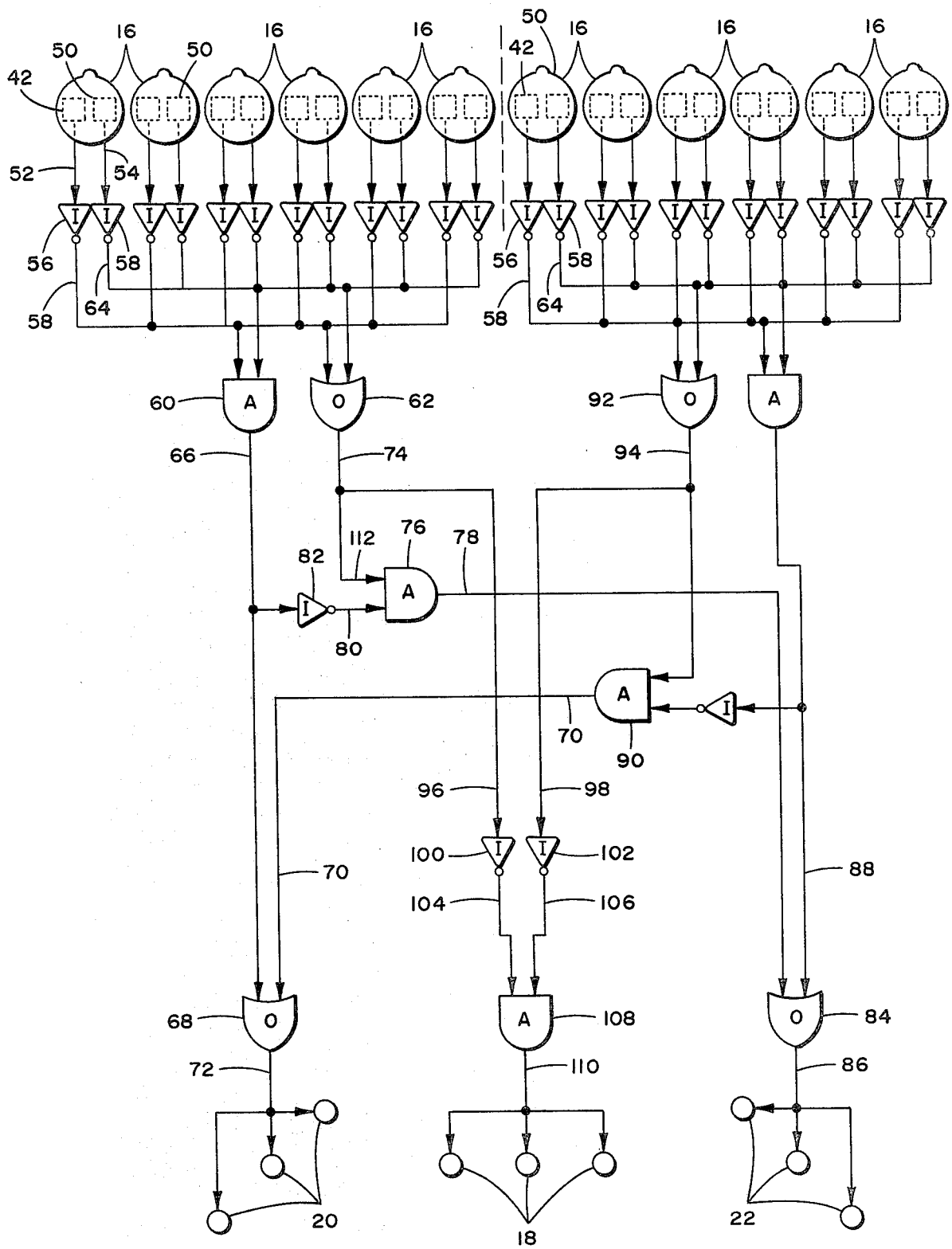
Figure 5:
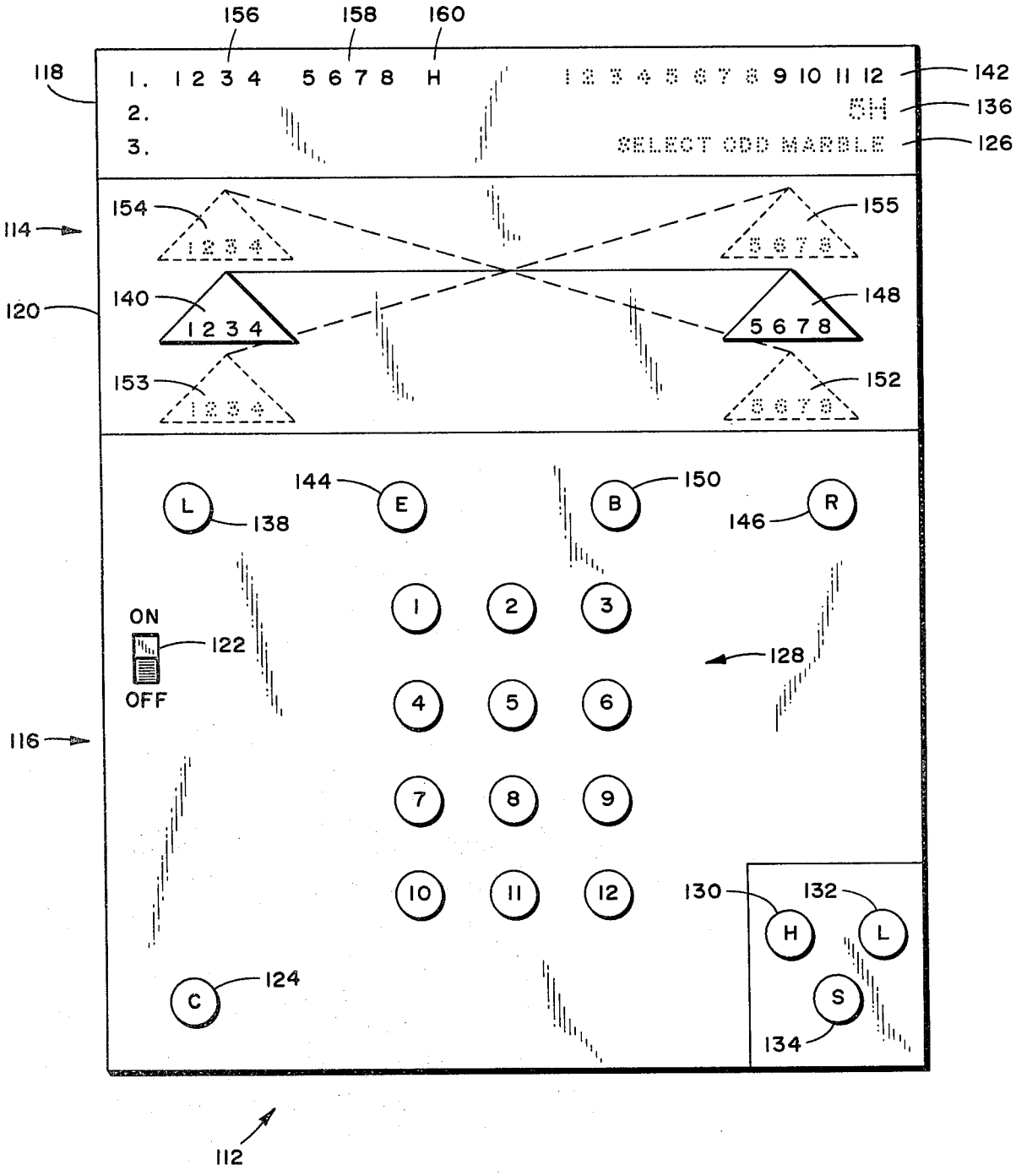
Figure 6:
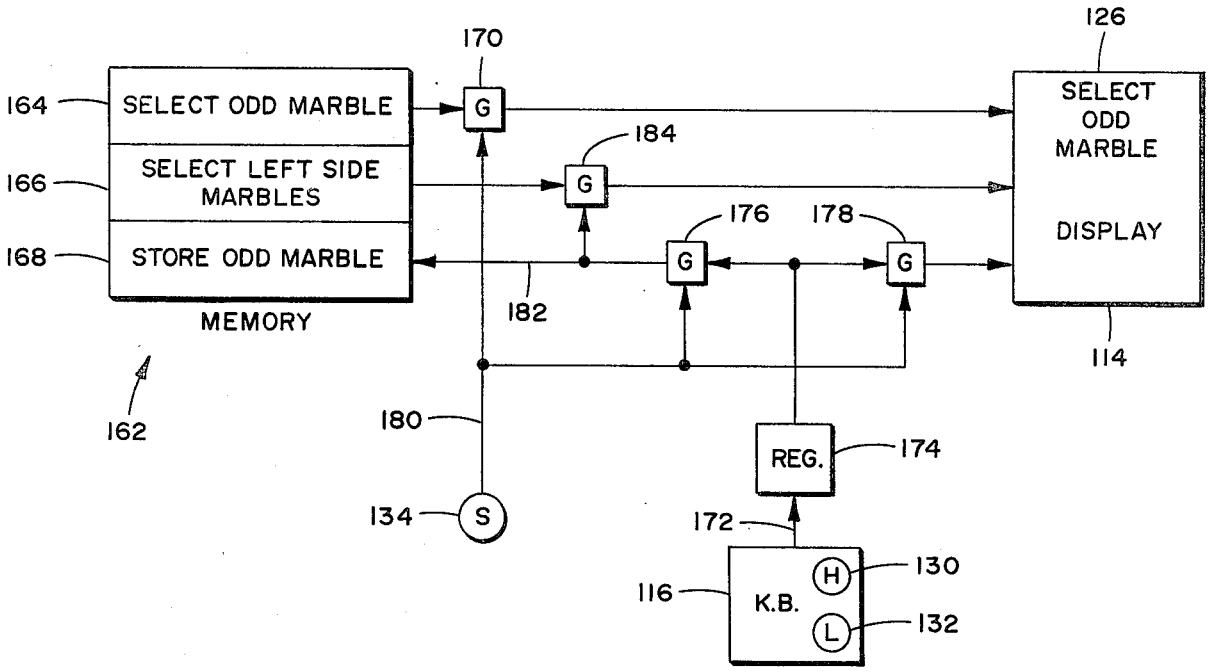
Figure 7:
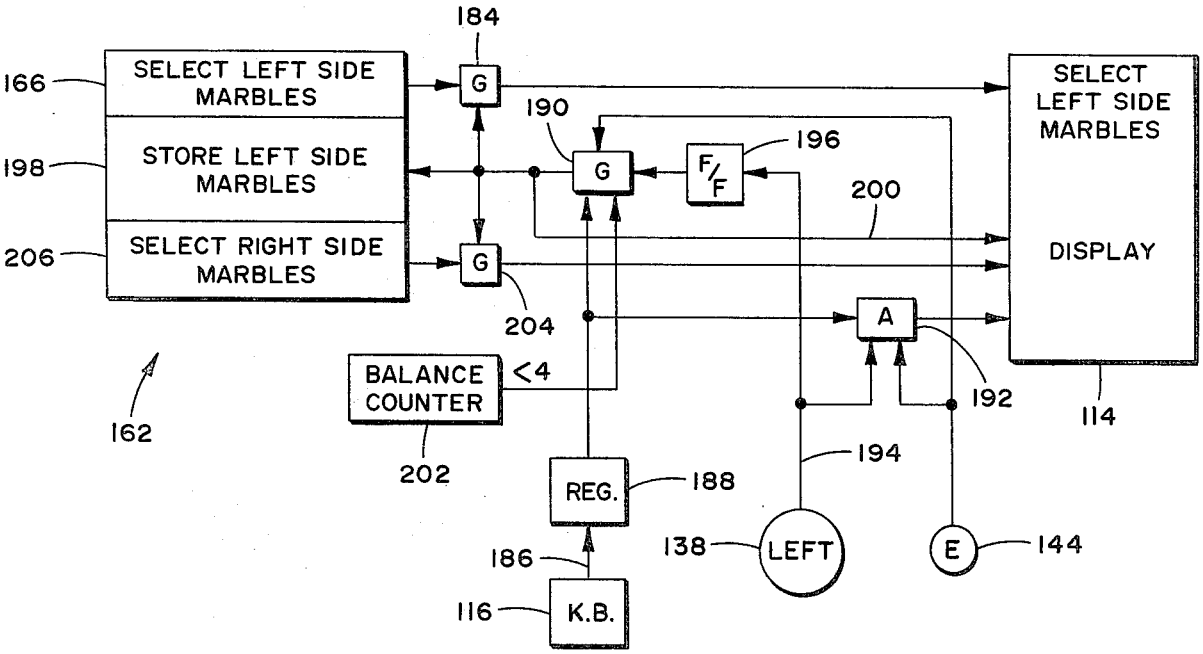
Figure 8:
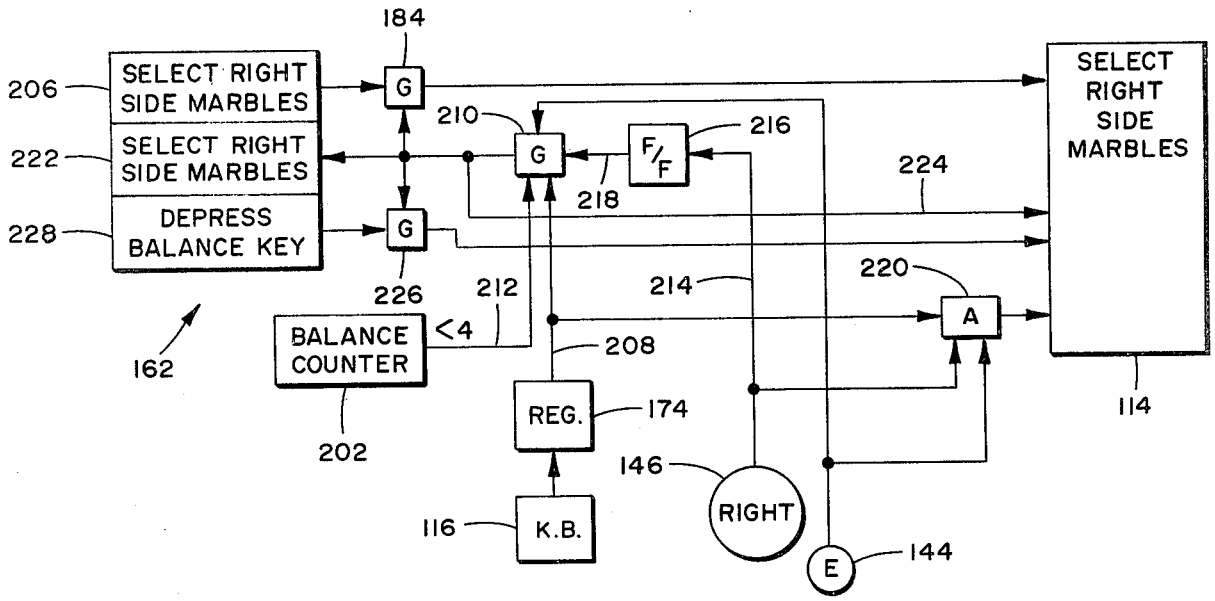
Figure 9:
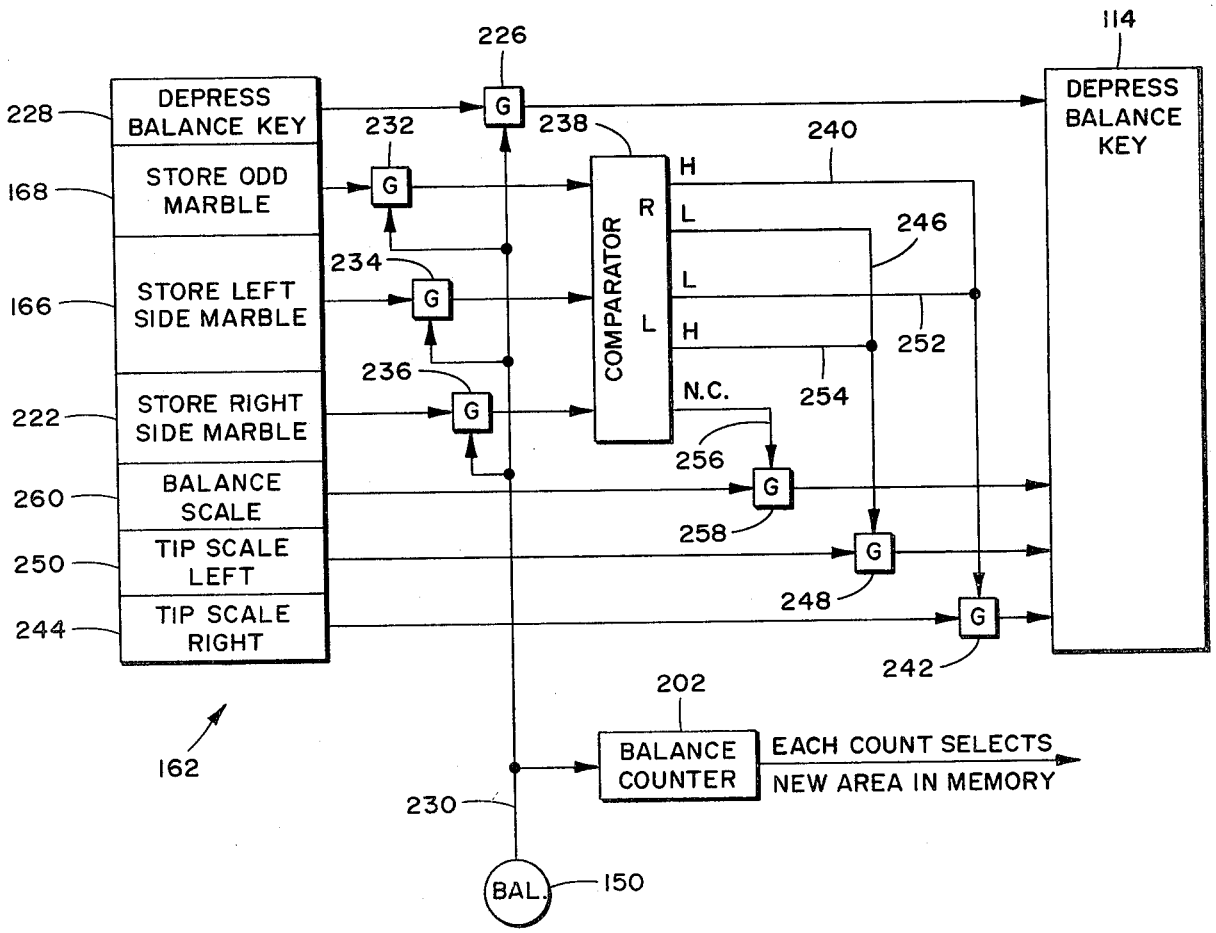
Figure 10:
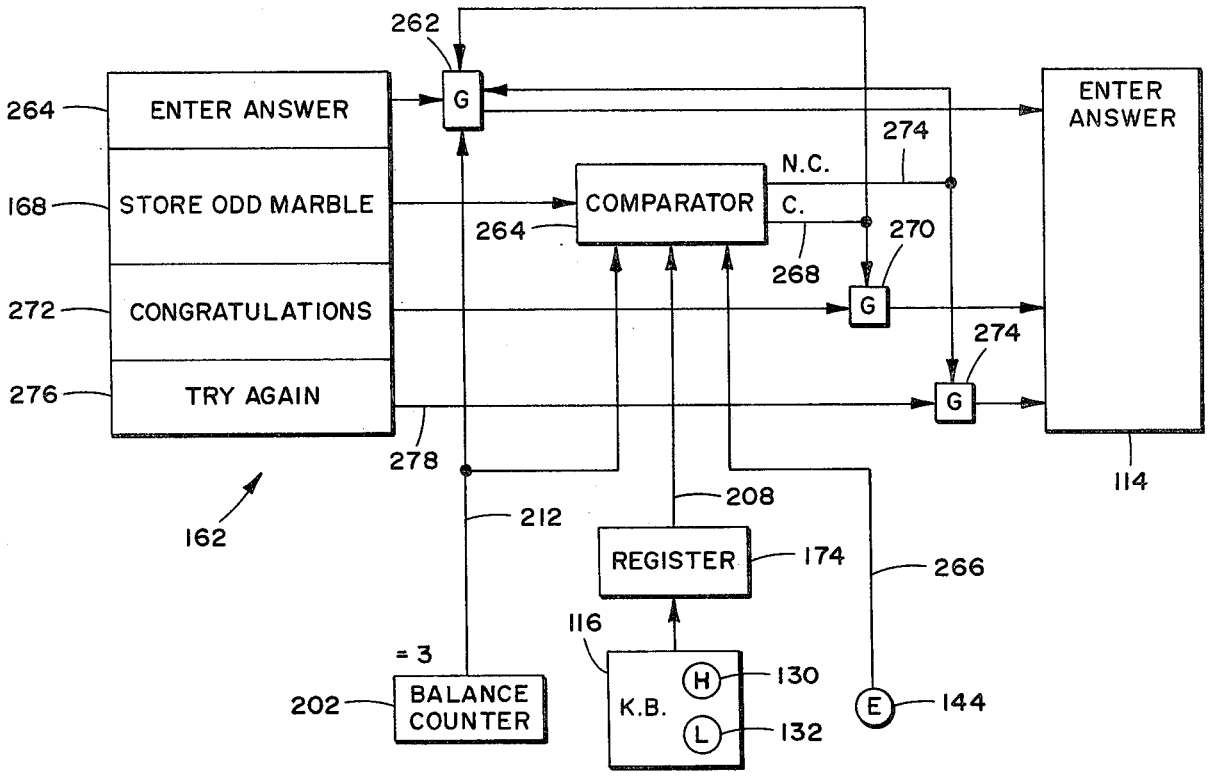
Figure 11:
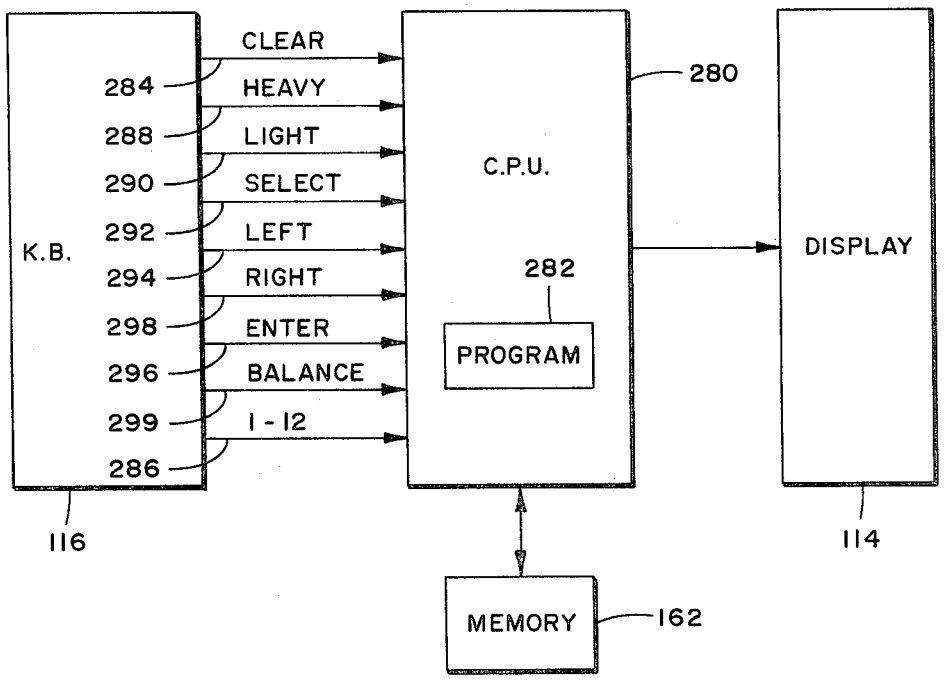
Figure 12A:
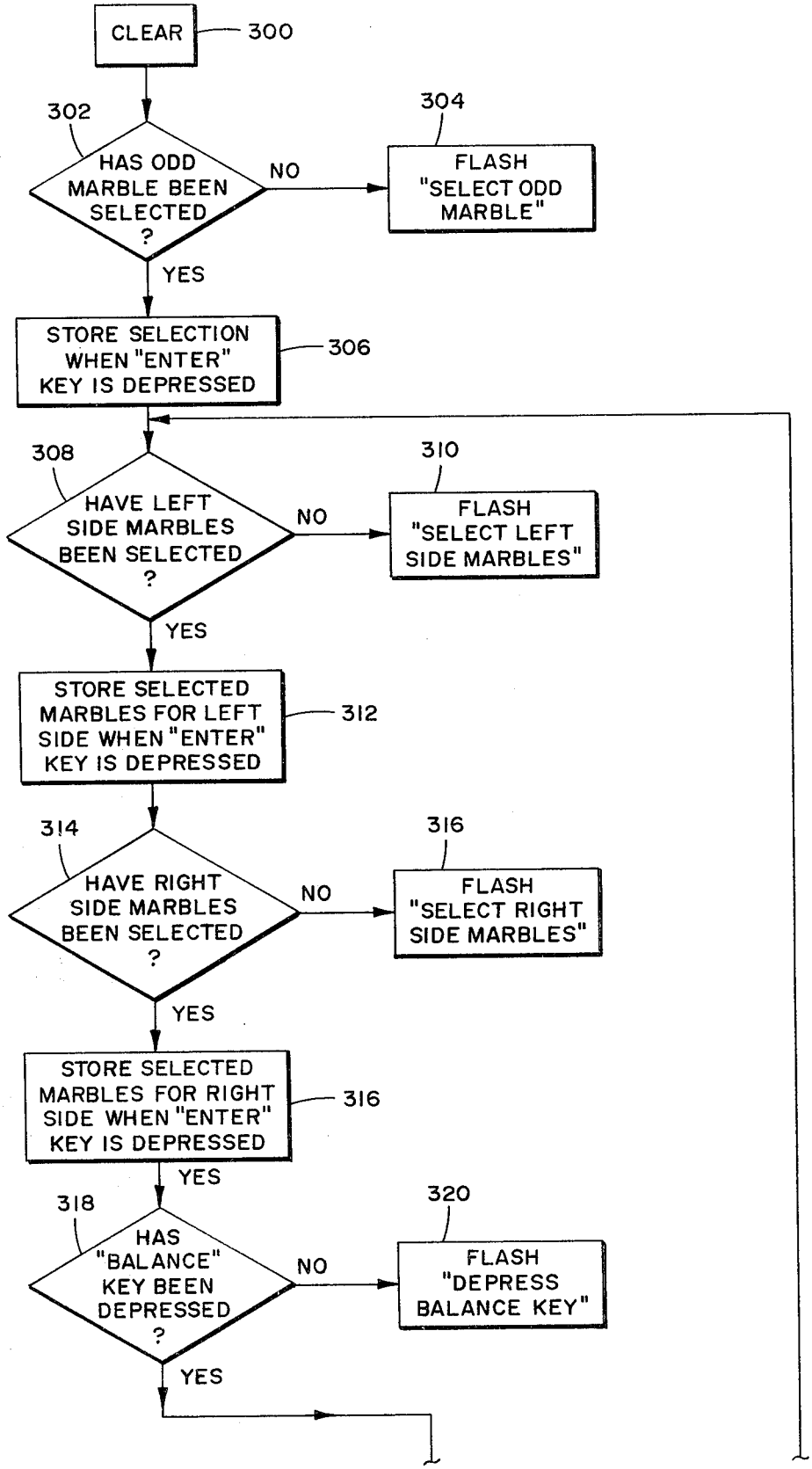
Figure 12B:
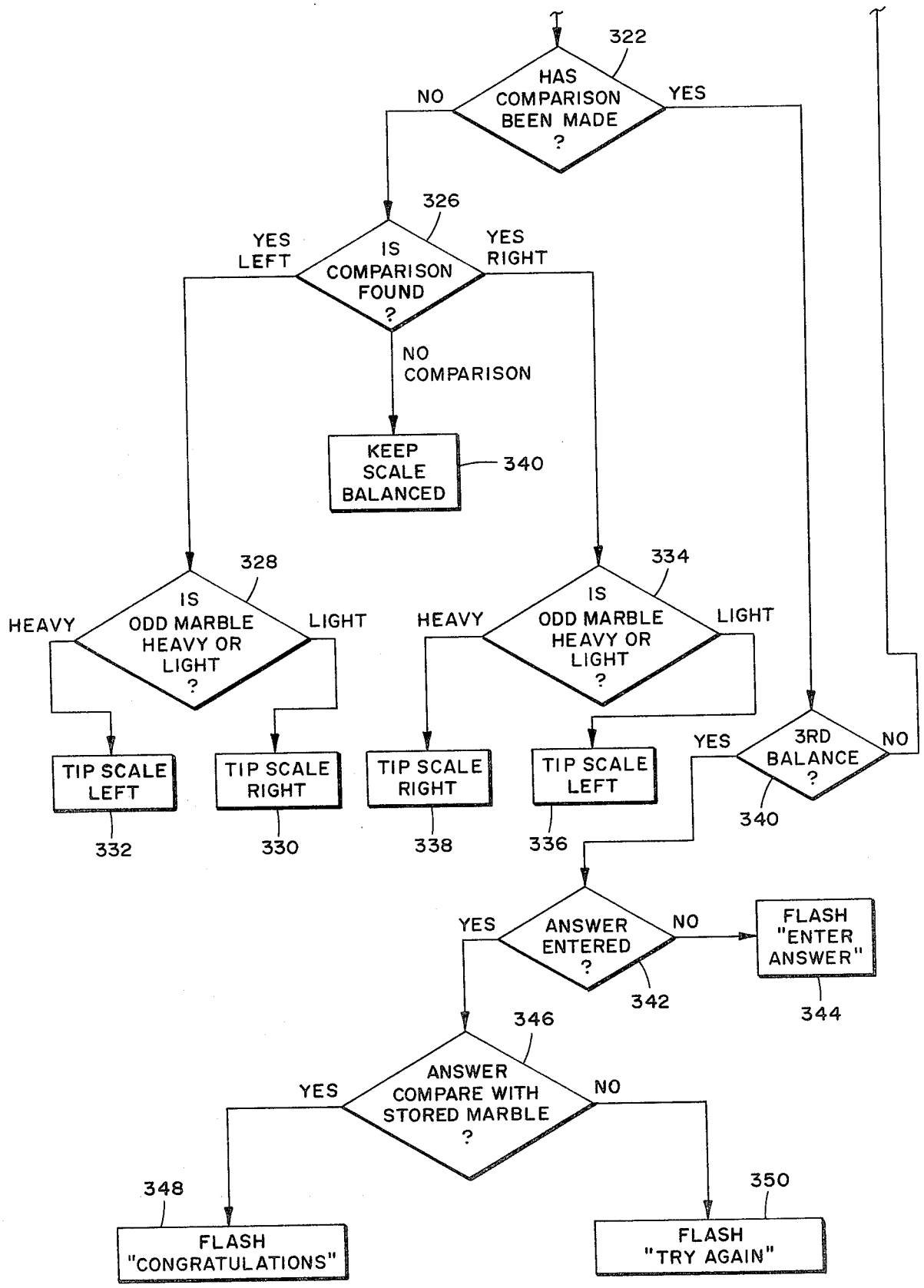

FIGS. *2a, 2b,* and *2c* are diagrammatic representation of a portion of the simulated electronic balance scale of FIG. 1 and the playing pieces which represent heavy or light pieces to be placed on said balance scale;

FIG. 3 represents the detachable numerals which may be detachably fastened to the individual playing pieces by means of Velcro or other attaching means;

FIG. 4 is a schematic diagram of the electrical circuit of said simulated balance scale;

FIG. 5 is a diagrammatic representation of a hand held electronic logic game having a display of a simulated balance scale and a keyboard through which selected ones of a predetermined number of simulated playing pieces may be placed on the simulated balance scale and an indication of balance or unbalance given;

FIG. 6 is a schematic representation of the circuitry of the hand held logic game of FIG. 5 which is necessary to select and enter into memory the odd playing piece or marble and the designation of whether it is heavy or light;

FIG. 7 is a schematic representation of the circuitry for the hand held electronic logic game of FIG. 5 which is necessary to enable the user to select and store in memory the marbles or playing pieces which are to be placed on the left side of the simulated balance scale;

FIG. 8 is a schematic representation of the circuitry for the hand held electronic logic game of FIG. 5 which is necessary for the user to select and store in memory the marbles or playing pieces which are to be placed on the right hand side of the simulated balance scale;

FIG. 9 is a schematic representation of the circuitry for the hand held electronic logic game of FIG. 5 which is necessary for the user to cause a comparison of the stored data representing the odd marble or playing piece with the stored data representing the marbles on the left or right side of the balance scale and which will cause the scale to either be balanced or tipped to the right or left;

FIG. 10 is a schematic representation of the circuitry for the hand held electronic logic game of FIG. 5 which is necessary for the user to enter his selection of the marble or playing piece which he has determined to be the odd marble or playing piece and whether or not it is heavy or light; further, the circuitry shown in FIG. 10 gives an indication of whether or not the selected answer is correct;

FIG. 11 is a schematic diagram of the circuitry for the hand held electronic logic game of FIG. 5 which is controlled by a program which, depending upon the signals received from the keyboard, can retrieve the appropriate data from the memory and display it; and FIGS. 12*a* and 12*b* are copies of the decision tree necessary for the program to be developed to control the circuitry disclosed in FIG. 11.

DETAILED DESCRIPTION OF THE DRAWINGS

A logic game that is old and well-known in the art comprises a predetermined number of objects such as marbles, one of which is different from the others in weight, either heavier or lighter. Assuming the number of such marbles or devices to be twelve, the logic game consists in utilizing a scale by which various combinations of the marbles are "weighed" three times and by observing the condition of the scale after each "weighing". If the correct number of marbles have been weighed each time, the odd marble, and whether it is heavy or light, can be determined.

While the logic game is exciting and challenging, it is difficult to actually perform because twelve marbles or playing pieces don't actually exist which has one of them either heavier or lighter than the others. If such marbles did exist, then it would be difficult to find a balance scale sufficiently accurate to detect small differences of weight so that one could not tell the odd marble simply by comparing the weight of the marbles by hand "feel".

Thus, the present invention relates to a simulated electronic balance scale as shown in FIG. 1. The scale comprises a board 10 on which is positioned two areas 12 and 14 representing the left and right sides of a balance scale respectively. In each of the areas 12 and 14 are located a plurality of positions 16 which represent locations in which a marble or playing piece which is to be "weighed" may be placed. Also located on board 10 is a first set of lights 18, which may be light emitting diodes, which represent that the scale is balanced because of their horizontal alignment.

A second set of lights 20 are located at a 45° angle from lower left to upper right representing that the scale is tipped to the left or is heavy on the left side. A third set of light emitting diodes 22 are arranged on the right side at an angle from the upper left to the lower right representing that the scale is tipped to the right or is heavy on the right side. In each case, only one light could be used to indicate balance or unbalance by its position.

Also shown in FIG. 1 on board 10 are twelve playing pieces or marbles 24. One of said playing pieces 26 has an L on it to represent that it is of lighter weight than the other playing pieces. The manner in which this light weight is represented will be disclosed hereinafter. Also on board 10 is an extra playing piece 28 which has an H thereon which represents that its weight is heavier than the other pieces. The manner in which this heavier weight is represented will also be disclosed hereinafter. Also located on each playing piece is a Velcro strip 30 which will be used to attach a removable identification number as will be more fully disclosed hereinafter. Finally, an on/off switch 32 is located on board 10 so that the power source may be disconnected from the board when it is not being used. The power source, not shown, may be a battery of appropriate voltage or any other appropriate voltage source.

Figure 2:
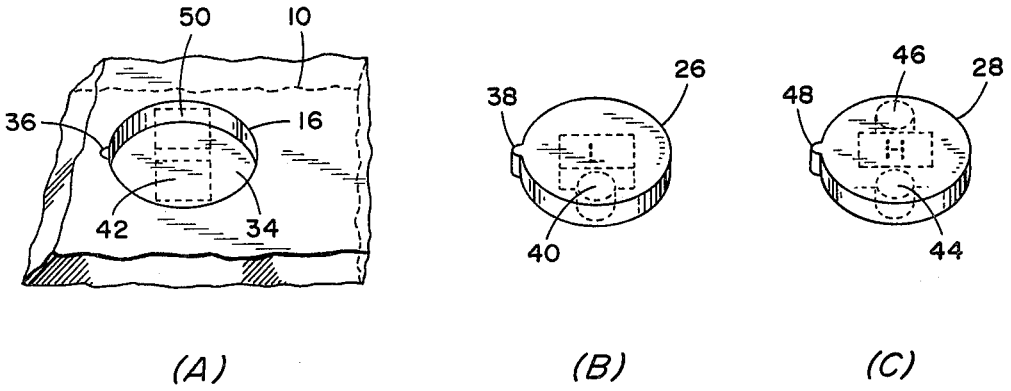

FIG. 2A discloses a segment of board 10 encompassing one of the playing piece locations 16 which is disclosed as a recess 34 having a slot 36 therein. As can be seen in FIG. 2B, the playing piece 26 having the L thereon representing that this piece is lighter in weight than the other pieces is circular in shape so that it can fit in recess 34 in FIG. 2A. It must be aligned so that detent 38 on playing piece 26 fits in slot 36 of recess 34. One magnet 40 is physically positioned in playing piece 26 such that when playing piece 26 is positioned in recess 34 with detent 38 in slot 36, magnet 40 rests over a magnetic switch 42 otherwise known as a Hall effect device. The Hall effect device 42 will be actuated by the proximity of magnet 40 in playing piece 26 and will give an indication in the circuit disclosed in FIG. 4 that can be utilized to indicate that playing piece 26 is lighter than the remaining pieces. In like manner, the playing piece 28 shown in FIG. 2C represents a playing piece that is heavier than the remaining pieces and includes first and second magnets 44 and 46 respectively. When playing piece 28 is placed in recess 34 such that its detent 48 matches with slot 36, magnet 44 is in proximity to magnetic switch 42 while magnet 46 is in proximity to magnetic switch 50. Thus both magnetic switches 42 and 50 produce signals which can be utilized in the circuit of FIG. 4 to indicate that playing piece 28 is heavier than the remaining playing pieces.

Since the playing pieces 24 in FIG. 1 are to be physically placed in recesses 16 on both sides of the simulated balance scale, and since three measurements are to be taken wherein it will be necessary for certain of the pieces 24 to be removed from one side to the other of the balance scale, it is important that the playing pieces 24 be numbered. However, if the numbers are placed permanently on the playing pieces 24, when the light playing piece 26 or the heavy playing piece 28 has been discovered, the one who discovered it will know thereafter which piece is heavy and which piece is light. Therefore, by placing a Velcro strip 30 on each playing piece 24, a plurality of numbered strips 52 having a Velcro backing on each piece can be detachably fastened to the top of each playing piece 24. Thus, playing pieces 26 and 28 which have L and H thereon respectively can be covered with a Velcro strip 52 and the number changed with each game as desired. Thus, light playing piece 26 may have number 1 in one game and in the second game the number 1 strip 52 may be removed and number 12 or any other number placed thereon. The Velcro backing will allow the strips to be readily attached and detached from the playing pieces.

The circuitry for providing such a simulated electronic balance scale is illustrated schematically in FIG. 4. Each of the recesses 16 has therein first and second Hall effect devices 42 and 50. These switches produce an output voltage unless a magnet is placed in the proximity thereof which turns the magnetic switch off and causes zero output from the switch. Assume in this case that either no playing pieces 24 are placed in recesses 16 or that playing pieces 24 without any magnets therein are placed in recesses 16. In that case, each of the magnetic switches 42 and 50 are producing outputs on their respective output lines 52 and 54. Since the operation is identical for each of the magnetic switches 42 and 50, the operation of only one of them will be discussed.

The output of magnetic switch 42 on line 52 is coupled to inverter 56. Since an input signal is present on input line 52 to inverter 56, no signal is present on output line 58 which is coupled to AND gate 60 and OR gate 62. In like manner, magnetic switch 50 produces an output on line 54 which is coupled to the input of inverter 58. No signal appears on the output of inverter 58 on line 64 which is also coupled as another input to AND gate 60 and to OR gate 62.

Since AND gate 60 has no signals on the input thereto, there is no signal on output line 66 which is coupled to OR gate 68. As will be seen hereinafter, no signal is present on line 70 to OR gate 68 and thus there is no output on line 72 of OR gate 68 and lights 20 are not energized. With no output on output line 74 from OR gate 62, AND gate 76 will not produce an output on its output line 78 even with an input signal on the other input line 80. Such an input signal exists on input line 80 because inverter 82 has no signal on its input line 66 from AND gate 60 and thus produces an output on line 80. With no signal on the output line 78 of AND gate 76, OR gate 84 does not produce an output on its output line 86 to energize lights 22. The other input 88 to OR gate 84 functions in exactly the same manner as already described with respect to input line 66 to OR gate 68 and thus OR gate 84 does not produce an output on output line 86. AND gate 90 operates in exactly the same manner as described for AND gate 66 and thus does not produce an output on its output line 70 which is coupled to OR gate 68 as discussed earlier.

However, OR gates 62 and 92 both have no outputs on their output lines 74 and 94 respectively and these signals are coupled on lines 96 and 98 respectively to the inputs of inverters 100 and 102, respectively. Since inverters 100 and 102 have no inputs, they produce output signals on their respective output lines 104 and 106 which are connected as inputs to AND gate 108. Because AND gate 108 has a signal on both input lines, it produces an output signal on line 110 which activates lights 18 to indicate that the simulated balance scale is in its balanced condition. Thus it can be seen that when no playing pieces are located in depressions 16 or when playing pieces having no magnets are located in depressions 16, lights 18 of the simulated balance scale are lit to give an indication of a simulated balance.

If a playing piece having one magnet therein, which represents a light playing piece, is placed on either side of the simulated balance scale, the circuit action results in an indication of an unbalanced scale. Thus, the circuit operation will be described as if the playing piece with one magnet therein were located in the outer most recess 16 on the left hand side. Assume in that case that the magnet in the playing piece were placed in abutting relationship to magnetic switch 42. (Although the operation would result in the same unbalance indication if the single magnet was placed in abutting relationship to magnetic switch 50). No signal would then appear on the output of magnetic switch 42 on line 52. Inverter 56, having no input, would produce an output signal on line 58 which is coupled to AND gate 60 as one input and to OR gate 62 as one input. There is a signal output from magnetic switch 50 on line 54 to inverter 58 however. This means, as described earlier, that no output appears on line 64 of inverter 58 which is also coupled to AND gate 60 and OR gate 62. Since only one input line to AND gate 60 is activated, no output appears on line 66. However, an output does appear from OR gate 62 on line 74. The output of OR gate 62 on line 74 is coupled as an input to inverter 100 on line 96 which causes no output from inverter 100 on line 104 as an input to AND gate 108. Thus, AND gate 108 is disabled and can not produce an output on line 110 to activate lights 18. In like manner, no output from AND gate 60 on line 66 is coupled to OR gate 68 and, as discussed earlier, AND gate 90 has not output on line 70 coupled to OR gate 68 and thus there is not output on line 72 from OR gate 68 and thus lights 20 are not activated.

However, the output from OR gate 62 on line 74 is coupled as an input to AND gate 76 on line 112. Likewise, as discussed earlier, an input appears on line 80 to AND gate 76 from inverter 82 because AND gate 60 does not produce an output on line 66. Thus, with both inputs present on lines 80 and 112 to AND gate 76, an output appears on line 78 which is coupled to OR gate 84. Thus, there is an output on line 86 from OR gate 84 which activates lights 22. Since lights 22 are on the right side of the balance scale and are tipped from the upper left to the lower right, they indicate that the scale is unbalanced to the right side. This would be the case if a light object were placed on the left side of the scale with normal weight objects on the right side of the scale. The scale would then tip to the right and the lights 22 would so indicate. The scale would operate in a similar manner if a playing piece with one magnet therein were placed in recess 16 on the right side since AND gate 90 would then be activated by the output from OR gate 92 and the output of AND gate 90 on line 70 would pass through OR gate 68 producing an output on line 72 to actuate lights 20 which would indicate that the scale is tipped to the left or that the light weight is appearing on the right side. Thus, with a playing piece having one magnet therein which simulates a playing piece having a light weight, placed on either the right or the left side of the simulated balance scale, the light will be actuated on the opposite side of the scale to indicate that the scale is heavy on the opposite side, which is as it should be.

If a playing piece having two magnets therein is placed on either the left or the right side of the simulated balance scale, it would indicate that a playing piece heavier than the normal piece is placed on that particular side and lights on that particular side should be activated. Thus, if the playing piece with two magnets is placed on the left side of the simulated balance scale, lights 20 should be activated to indicate that the scale is tipped to the left because of the heavier weight or if it is placed on the right side of the simulated balance scale, lights 22 should be activated to indicate that the scale is heavy on the right and is tipped to the right. Since the operation of the circuit is the same wherever the playing piece with the two magnets is located, assume that the playing piece with two magnets is located in the outer most recess 16 on the left hand side of the balance scale. In that case, both magnetic switches 42 and 50 are activated by the presence of the magnets which causes them to turn-off and no output is produced on respective output lines 52 and 54 which are coupled to inverters 56 and 58 respectively. This causes the outputs of inverters 56 and 58 on lines 58 and 64 to be produced which are coupled as inputs to both AND gate 60 and OR gate 62. Now, both AND gate 60 and OR gate 62 produce outputs on their respective output lines 66 and 74. Because there is an output from OR gate 62 on line 74, the input to inverter 100 on input line 96 causes no output from inverter 100 on line 104 thus, disabling AND gate 108. No output then appears on line 110 from AND gate 108 and lights 18 are not activated. In like manner, with an output from AND gate 60 on line 66, inverter 82 does not produce an output on its output line 80 which is coupled to AND gate 76. Thus, AND gate 76 is disabled and no output appears on line 78 even though there is an input on line 112 from OR gate 62. With no output on line 78 from AND gate 76, OR gate 84 does not produce an output on line 86 and lights 22 are also disabled. However, the output of AND gate 60 on line 66 is coupled directly to OR gate 68 which produces an output on line 72 and activates lights 20 to indicate that the balance scale is heavy on the left and is therefore tipped to the left.

With the circuit as shown in FIG. 4, a simple simulated electronic balance scale is made available which has a plurality of playing pieces, one of which differs from the others electronically by one of two states and selected ones of the playing pieces 24 can be symbolically positioned on the simulated balance scale by placing them in recesses 16. In the first weighing, if the scale balances it is obvious that the "odd" playing piece is located with the group that was not placed on the balance scale and thus the next weighing can include certain ones of those playing pieces which were not used in the first weighing. In like manner, the third weighing will utilize particular ones of said playing pieces to enable the user, by the end of the third weighing, to logically discover which of the playing pieces is the odd one and whether it is heavy or light. The magnetic switches 42 and 50 associated with the simulated balance scale can detect the different playing piece if it is symbolically positioned on the simulated balance scale. The circuit shown in FIG. 4 thus has a first logic circuit coupled to the magnetic switches 42 and 50 and lights 20 or 22 for energizing the lights 20 or 22 on the opposite side of the simulated balance scale than the side on which the playing piece with one magnet is positioned to simulate that the opposite side of the scale is heavy and a second logic circuit coupled to magnetic switches 42 and 50 for energizing the lights 20 or 22 on the same side of the simulated balance scale as that side on which the playing piece with first and second magnets is positioned to simulate that the same side of the scale is heavy. Of course the third logic circuit which is coupled to the magnetic switches 42 and 50 and lights 18 can energize lights 18 to represent a balanced scale when no playing piece having either said first and second magnets is positioned on either side of the simulated balance scale.

The preferred embodiment of the present invention is disclosed in FIG. 5 which is a diagrammatic representation of a hand held electronic logic game. The game is generally designated by the numeral 112 and consists of an upper display portion 114 and a keyboard portion 116. The display portion 114 is divided into an upper portion 118 and a lower scale portion 120. Display 114 may be either the liquid crystal type or may utilize light emitting diodes, nixie tubes, and the like for displaying the relevant information.

Keyboard 116 includes an on/off switch 122 to connect and disconnect the power supply to the circuitry thereof. Upon turning the power on through activating switch 122, all pertinent registers in game 112 in the memory thereof are cleared. However, a clear key 124 is provided so that any entry made through the keyboard can be changed if desired simply by depressing the clear key 124.

Inasmuch as the object of the game is to detect the "odd" playing piece or "marble", the first step is for one individual to select the "odd" marble. The program prints the steps to be followed in the upper portion 118 of display 114 such as, for instance, at 126 which states "SELECT ODD MARBLE".

The individual selecting the "odd" marble would depress the desired one of the numerical keys 128 such as, for instance, key 5 and then the appropriate key 130 or 132 marked H and L respectively to indicate a heavy or a light marble. Thus, if it is desired to select marble 5 as a heavy marble, key 5 would be depressed and then key H, designated by the numeral 130, would be depressed. This would store the data representing key 5H in a temporary storage register. This data is displayed in the upper portion 118 of display 14 as at 136 so that the individual can see the selected odd marble. Upon depression of the select key 134, the data temporarily stored in the input register is stored in memory and the visible indication at 136 of the selected marble is removed from the display. At the same time, the display then prints "SELECT LEFT SIDE MARBLES" at 126. Game 112 is then given to the party or individual who is to solve the logic problem by finding the selected odd marble and determining whether or not it is heavy or light in three observations of the balance or unbalance of the scale on portion 120 of display 114.

At this point, the individual depresses key 138 which is marked L for left and depresses the appropriate ones of keys 128 to indicate which of the marbles he wishes to place on the left side of the scale. Suppose, for instance, he wishes to place marbles 1, 2, 3 and 4 on the left side of the scale. These keys are depressed in sequence and they appear on the left side of the balance scale as indicated at 140. Initially, the numbers 1 through 12 are shown on the upper portion 118 of display 14 as at 142. As each of the numerical keys 128 is depressed to enter certain of the numbers on the left side of the balance scale as at 140, they are removed from the area 142 in the upper portion 118 of the display 114 in order to show those marbles or playing pieces that are left and haven't been used. Thus, at this point with numbers 1, 2, 3 and 4 having been placed on the left side of the balance scale as at 140, the numbers 5 through 12 remain on the display in area 142.

If the operator is satisfied that these are the four playing pieces which he desires to place on the left side of the balance scale, he depresses "ENTER" key 144 which stores the data in the upper register depressing marbles 1 through 4 in the memory for the left side of the balance scale. If, however, prior to the depressing of the "ENTER" key 144, it was desired to change the playing pieces in the area 140 on the display, the clear key 124 could be depressed and the input register would be cleared and the numbers 1 through 4 returned to the area 142 in the upper portion 118 of the display 114.

Once the marbles or playing pieces have been placed on the left side of the simulated balance scale, and the "ENTER" key 144 has been depressed, this causes the program to print "SELECT RIGHT SIDE MARBLES" in area 126 of the upper portion 118 of display 114. This is accomplished by depressing key 146 which is marked with an R to indicate "right side". The desired numerical keys 128 are then depressed sequentially and the data stored by these keys is stored in the input register. At the same time, as each numerical key 128 is depressed, the selected numerals appear on the right side of the simulated balance scale shown in the lower part 120 of display 114 and indicated by the numeral 148. Thus, if numerals 5, 6, 7 and 8 were selected they would appear as shown at 148. If the operator is satisfied with his selection, he depresses "ENTER" key 144 which transfers the data from the input register to the memory in the proper registers where it is stored.

The operator may now observe the results of his selection by depressing the balance key 150 which is marked with a B to indicate "BALANCE". When balance key 150 is depressed, appropriate circuitry or a program causes the stored data representing the odd playing piece to be compared with the data representing each of the playing pieces on each side of the balance scale at 140 and 148. It was initially assumed that playing piece 5 designated as heavy was stored in memory as the "odd" playing piece. The computer determines that playing piece 5 is located on the right side of the simulated balance scale at 148 and since the stored data designates playing piece 5 as heavy, it tips the scale to the right as shown at 152 with the left portion of the scale moving upwardly to position 154. The operator then knows that either playing piece 1, 2, 3 or 4 is light or one of playing pieces 5, 6, 7 or 8 is heavy. At the same time, the upper portion 118 of display 114 records at 156 and 158 the playing pieces that were placed on each side of the simulated balance scale and an indication H at 160 to indicate that the right side of the scale was heavy. This information is retained so that the operator can see which of the playing pieces were being used each time in each "weighing".

A counter or a program keeps track of the number of weighings and if the count is less than 3, after a predetermined time delay, the simulated balance scale is returned to its balanced position and the numerals removed therefrom. The operator then performs a second balance and a third balance exactly as the first one was performed.

At the end of the third balance or weighing, if the operator has correctly weighed the proper playing pieces, he can determine or discover logically which of the pieces is the odd piece and whether it is heavy or light. Therefore, after the third weighing, the circuitry displays at 126 "ENTER ANSWER". The operator depresses the numerical key he believes to be the correct one as well as key 130 or 132 depending upon whether the feels the odd playing piece is heavy or light. He then depresses the enter key 144. The memory compares the stored data representing the odd playing piece with the data entered by the operator and if a comparison is made enters on the display at 126 "CONGRATULATIONS". If the comparison is not made, the circuitry enters "TRY AGAIN".

The circuitry for performing the operations described earlier will be shown hereinafter. FIG. 6 discloses the circuitry for displaying the requests to "SELECT ODD MARBLE" and when the odd marble has been selected, it displays "SELECT LEFT SIDE MARBLES". Thus, as can be seen in FIG. 6, memory 162 includes three storage areas wherein data is stored at 164 representing the phrase "SELECT ODD MARBLE" while the phrase "SELECT LEFT SIDE MARBLES" is stored at 166 in memory and area 168 in memory is reserved to store the data representing the selected odd marble. When the display is first energized, gate 170 is automatically enabled and the data stored in memory at 164 causes the display 114 to display "SELECT ODD MARBLE" at 126. To select the odd marble, the appropriate numerical key 128 on keyboard 116 is depressed along with the heavy or light key 130 or 132 respectively. This information is coupled via line 172 to register 174. The output of register 174 is coupled to gates 176 and 178. Gate 178 is normally enabled to display the selected "odd" marble. When select switch 134 is depressed, the data on line 180 disables gate 170 which removes from the display 114 the phrase "SELECT ODD MARBLE". In addition, the output on line 180 enables gate 176 and disables gate 178. Because gate 178 is disabled, it removes the data representing the selected odd marble from display 114 where it was displayed. In addition, the data is coupled through gate 176 on line 182 to storage area 168 in memory 162 where it is retained for comparison at the end of the game. Further, the output of gate 176 is also coupled to gate 184 which is enabled and couples the data stored in area 166 in memory 162 to the display to indicate "SELECT LEFT SIDE MARBLES". When the select switch 134 is released, gate 178 remains disabled.

FIG. 7 discloses the circuitry for enabling the marbles on the left side to be selected and stored and the operator notified to select the right side marbles. As illustrated in FIG. 7, gate 184 is enabled as indicated in relation to FIG. 6 and the data stored in area 166 in memory 162 is coupled to display 114 to indicate "SELECT LEFT SIDE MARBLES". To accomplish this, the operator depresses the appropriate numerical keys on keyboard 116 which generate an output on line 186 to register 188. The output of register 188 is coupled to gate 190 and gate 192. When the operator depresses left side key 138, the output on line 194 enables gate 192 and sets flip/flop 196. Gate 192 couples the selected data in register 188 to the display where it is displayed on the left side of the screen at 140 as shown in FIG. 5. If, at this point, the operator is not satisfied with the selected data, he may depress the clear key 124 shown in FIG. 5 and clear register 188 and re-select the desired playing pieces by depressing the desired numerical keys 128. If the operator is satisfied with his selection, he depresses "ENTER" key 144 which provides the final enable to gate 190 which couples the data stored in register 188 representing the selected playing pieces for the left side to area 198 in memory as well as on line 200 to the display where it is stored in area 156 in upper portion 118 of the display as well as area 140 on the simulated balance scale. The output from depressing key 144 also disables gate 192 so that the temporary coupling of the data to the display is removed. It will be noted that balance counter 202 is coupled to gate 190 and, if the number of balances is less than 4 (that is 1, 2 or 3); gate 190 can be activated. This is to prevent more than three measurements or observations being taken. Also, the output of gate 190 disables gate 184 to remove "SELECT LEFT SIDE MARBLES" from the display and gate 204 is enabled to display "SELECT RIGHT SIDE MARBLES" which is stored in area 206 of memory 162.

FIG. 8 is a schematic representation of the circuitry necessary to display the "SELECT RIGHT SIDE MARBLES", to store the data for the selected marbles for the right side and to enable the balance key to be depressed to cause a balance to occur. As discussed previously with respect to FIG. 7, section 206 of memory 162 stores the data representing "SELECT RIGHT SIDE MARBLES" which data is coupled to gate 184 and displayed on the appropriate section of display 114. The operator then depresses the desired numerical keys 128 on keyboard 116 and the data is stored in temporary storage register 174. The output of register 174 on line 208 is coupled as an input to gate 210. If balance counter 202 has counted less than 4 balances, it produces an enabling output on line 212 to gate 210. In like manner, after the data from keyboard 166 has been entered in register 174, the key 146 which represents the selection of the right side of the balance scale is depressed which produces an output on line 214 which sets flip/flop 216 which, in turn, produces an enabling signal on line 218 to gate 210. At the same time, the output of register 174 on line 208 is coupled to gate 220 which is enabled whenever key 146 which selects the right side of the balance scale is depressed. The output of gate 220 is coupled to display 114 where the selected "marbles" are displayed. If the operator is dissatisfied with his selection, he may, as stated earlier, depress the clear key 124 on the keyboard which clears register 174 and he may make another entry. If he is satisfied, he depresses "ENTER" key 144 which produces a disabling output to gate 220 thus removing the display of the selected marbles as stored in register 174 and enabling gate 210 to couple the output from register 174 to area 222 of memory 162. At the same time, the output of gate 210 is coupled on line 224 to display 114 where the selected marbles are displayed on the right side of the simulated balance scale. Simultaneously, the output of gate 210 is coupled to gate 184 as a disabling signal which removes from the display "SELECT RIGHT SIDE MARBLES" and enables gate 226 which couples the data from area 228 in memory 162 which represents the phrase "DEPRESS BALANCE KEY" to the display 114 where it is displayed as an instruction for the next step.

Once the marbles for both sides of the scale have been selected and have been entered in display areas 140 and 148 respectively on the simulated balance scale and in display areas 156 and 158 as permanent storage, then the balance key 150 can be depressed.

FIG. 9 discloses the circuitry for providing a balance or unbalance indication. The display 114 gives the next instruction as "DEPRESS BALANCE KEY" as set forth in the discussion of FIG. 8. When balance key 150 is depressed, the output on line 230 is coupled to balance counter 202 as stated earlier which keeps track of the number of balance simulations which occur. It is also coupled to gate 226 as a disabling signal which removes from the display the instruction "DEPRESS BALANCE KEY". The output of balance key 150 on line 230 is also coupled as enabling signals to gates 232, 234 and 236 which gate the output of the areas 166, 168 and 222 in memory to comparator 238. Comparator 238 compares the data representing the marbles stored in memory area 166 representing the marbles on the left side of the simulated scale with the data in memory area 168 representing the stored odd marble to see if there is a comparison. In like manner, it compares the data in memory area 222 representing the marbles stored on the right side of the scale with the data in memory area 168 representing the odd marble. If the comparator 238 finds a comparison with the marbles stored on the right side of the scale and if the data representing the stored odd marble indicates that the odd marble is heavy, the comparator produces an output on line 240 which enables gate 242 which couples the data from area 244 of memory 162 which represents "TIP SCALE RIGHT" to display 114 to tip the representation of the scale to the right as shown at 152 and 154 in FIG. 5. If the comparison with the marbles on the right side of the scale is found and the data representing the stored odd marble in area 168 of memory 162 indicates that the odd marble is light, the comparator produces an output on line 246 which enables gate 248 which couples the data in area 250 in memory 162 to display 114 which tips the scale to the left as indicated at 153 and 155 in FIG. 5. If the comparator 238 finds a comparison with the marbles stored on the left side of the scale, and if the stored odd marble data represents that the odd marble is light, the comparator 238 produces an output on line 252 which is coupled to gate 242 as an enabling signal which gates the data stored in area 244 of memory 162 to display 114 to cause the scale to be tipped to the right again, as indicated at 152 and 154 in FIG. 5. If the comparator finds a comparison on the left side of the scale and the stored odd marble is indicated as heavy, the comparator produces an output on line 254 which is coupled as an enabling signal to gate 248 which gates the data stored in area 250 of memory 162 to display 114 to tip the scale to the left as shown at 153 and 155 in FIG. 5.

If the comparator 238 cannot find a comparison of the data representing the odd marble with the data representing either the left or the right side marbles, it then produces an output on line 256 which enables gate 258 which, in turn, couples the data stored in area 260 of memory 162 to display 114 to maintain the scale in its balanced condition as shown at 140 and 148 in FIG. 5.

Balance counter 202 shown in FIG. 9 counts each time balance key 150 is depressed. After each depression of balance key 150, balance counter 202 selects in a well-known manner a new area in memory in which the data for the left and right side marbles is to be stored.

When balance counter 202 has counted three balances, it produces an output on line 212 which, as shown in FIG. 10, enables gate 262 which couples the data stored in area 264 of memory 162 to display 114 which is an instruction requesting the operator to "ENTER ANSWER". The output of balance counter 202 on line 212 is also coupled to comparator 264 which compares the data representing the stored odd marble in area 168 of memory 162 with the marble selected by the operator which the operator believes to be the odd marble. The operator enters the marble he believes to be the odd marble through keyboard 116 by depressing the numerical key 128 representing that marble and either the key 130 representing a heavy marble or key 132 representing a light marble. The signals produced by the depression of these keys is coupled from the keyboard to temporary storage register 174 whose output on line 208 is also coupled to comparator 264. When "ENTER" key 144 is depressed, the final enabling signal is coupled to comparator 264 through line 266. Comparator 264 then compares the data in area 168 in memory representing the stored odd marble with the data in register 174 representing the marble selected by the operator as the odd marble. If a comparison is found, the comparator produces an output on line 268 which is coupled to both gates 262 and 270. The signal coupled to gate 262 serves as a disabling signal which removes the display instruction "ENTER ANSWER" and gate 270 is enabled so that it couples the output of memory area 272 which stores data representing "CONGRATULATIONS" to display 114 where congratulations is displayed. If no comparison is found, the comparator 264 produces an output on line 274 which is coupled as a disabling signal to gate 262 to again remove the instruction "ENTER ANSWER" from the display 114. It is also coupled as an enabling signal to gate 274 which gates the output of area 276 in memory 162 on line 278 to display 114 to display the instruction "TRY AGAIN". Of course, any desired phrase could be stored such as "BETTER LUCK NEXT TIME".

While the circuits just described provide a novel manner in which the inventive logic game can be operated, it is considerably more attractive to utilize a program to perform the many steps set forth above which has to be performed by circuitry. Such a novel system is disclosed in FIG. 11 wherein a central processing unit 280 having a program 282 is coupled to the keyboard 116, display 114, and memory 162.

Thus, when the operator depresses the "CLEAR" key, keyboard 116 produces an output on line 284 which is coupled to the central processing unit wherein the program clears all temporary storage registers. When the "CLEAR" key has been depressed or, upon turning the power supply switch 122 to the on position, the program 282 will automatically clear the appropriate registers and display "SELECT ODD MARBLE" on display 114. When the odd marble has been selected by depressing the desired one of the numerical keys 128 to produce a signal on line 286 and the appropriate heavy or light key 130 or 132 respectively has been depressed to produce outputs on lines 288 or 290 respectively representing the heavy or light selection, and select key 134 has been depressed to produce an output on line 292, the CPU program 282 stores the data representing the selected odd marble in the appropriate location in memory 162. It also then flashes "SELECT LEFT SIDE MARBLES" on display 114 by gating the appropriate data from the proper area in memory 162 to display 114.

The operator then selects the desired marbles for the left side of the scale by depressing appropriate numerical keys 128 which again produce outputs on line 286 and depresses left side key 138 which produces an output on line 294 and the program 282 displays the selected marbles on the upper area of display 114. When the "ENTER" key 144 is depressed, a signal 296 is produced which signals program 282 to store the data representing the selected marbles for the left side in the appropriate area in memory 162. It also flashes on display 114 "SELECT RIGHT SIDE MARBLES". The operator again depresses key 146 representing the right side which produces an output signal on line 298 and the appropriate numerical keys 128 to produce an output on line 286. The program 282 couples this data to the display 114 to the appropriate area thereon for display. If the selection is satisfactory, "ENTER" key 144 is again depressed which produces an output on line 296 which is recognized by program 282 which then stores the data representing the selected marbles for the right side of the scale in the appropriate area in memory 162. It also flashes "DEPRESS BALANCE KEY" on display 114 by accessing stored data in the appropriate area in memory 162. When balance key 150 is depressed by the operator, a signal is produced on line 299 which is accepted by program 282 which then causes a comparison to be made between the stored data representing the odd marble and the stored data representing the marbles stored on the left and right side of the display. It causes the result of the balance operation to either maintain the scale balance as shown at 140 and 148 in FIG. 5 or to be tipped to the right as shown at 152 and 154 in FIG. 5 or tipped to the left as shown at 153 and 155 in FIG. 5, depending upon the result of the comparison.

The CPU program then determines whether or not three balances have occurred, if not, it again selects the data from the proper area in memory 162 to flash on display screen 114 "SELECT LEFT SIDE MARBLES" and the process is repeated again. This happens three times and after the third balance, the program detects the third balance and selects the data from the proper area in memory 162 to display "ENTER ANSWER" on display 114 in the proper area, such as 126 as shown in FIG. 5. When the answer has been entered by the operator depressing the appropriate numerical key 128 and either heavy or light key 130 or 132 respectively, the program 282 causes a comparison to be made and, if a comparison is found, selects data from the proper area in memory 162 to flash "CONGRATULATIONS" on display 114. If no comparison is found, program 282 selects stored data in the appropriate area in memory 162 and flashes on display screen 114 "TRY AGAIN" or any other desired expressions such as "BETTER LUCK NEXT TIME".

The decision tree for the program 282 is indicated in FIG. 12A and FIG. 12B. After clearing the appropriate temporary storage registers at 300, program 282 decides whether or not the odd marble has been selected at 302. If not, it causes the appropriate area in memory 162 to be accessed as at 304 to flash "SELECT ODD MARBLE" on display 114. If the marble has been selected, by depressing the "ENTER" key 144 as at 306, program 282 then decides at 308 whether or not the left side marbles have been selected. If not, it causes the appropriate area in memory 162 to be accessed to cause "SELECT LEFT SIDE MARBLES" to be displayed as indicated at 310. If the left side marbles have been selected, the program causes the corresponding data to be stored in memory 162 as indicated at 312 when the "ENTER" key is depressed.

The program then determines if the right side marbles have been selected as at 314. If not, again, the program accesses the appropriate area of memory 162 to cause "SELECT RIGHT SIDE MARBLES" to be displayed as indicated at 316. If the marbles for the right side have been selected, the program stores the data representing those right side marbles when the "ENTER" key is depressed as indicated at 316. The program then checks to see whether or not the "BALANCE" key has been depressed as indicated at 318. If not, the program selects the data from the appropriate area in memory 162 and flashes "DEPRESS BALANCE KEY" on display 114 as indicated at 320. If the "BALANCE" key has been depressed, the program checks to see if a comparison has been made at 322. If not, the comparison is made as indicated at 326. If a comparison has been found on the left, the program checks to see whether the odd marble stored data indicates heavy or light as at 328. If the data representing the odd marble indicates it is light, the program accesses the appropriate area in memory 162 to select data to cause the displayed simulated scale to be tipped to the right as indicated at 330. If the comparison is found and the data representing the stored odd marble indicates that the marble is heavy, the program accesses the appropriate area in memory to retrieve data to tip the scale to the left on the display as indicated at 332. If the comparison is found with the marbles on the right side of the scale, the program checks at 334 to determine whether or not the data representing the stored odd marble indicates that the odd marble is heavy or light. If the data indicates that the stored odd marble is light, the program accesses the appropriate area in memory 162 to retrieve data to tip the scale to the left as indicated at 336. If the data representing the stored odd marble indicates that the odd marble is heavy, the program accesses the appropriate area in memory to retrieve data which will tip the simulated balance scale to the right as indicated at 338. If no comparison is found with either the right of the left side, the program will keep the scale in its balanced state as indicated at 340.

Once the comparison has been made and the scale either tipped to the right or the left or maintained in its balanced state, the computer program 282 checks to see if three balances have occurred as indicated at 340. If not, the program starts the cycle over by flashing "SELECT LEFT SIDE MARBLES" on display 114. Once however three balances have occurred, the program then determines whether or not the operator has entered his answer to the logic puzzle as indicated at 342. If not, the computer accesses the appropriate area in memory 162 to retrieve data therein to cause the phrase "ENTER ANSWER" to be displayed on display 114 as indicated at 344. When the answer has been entered, the program 282 compares that answer with the data representing the stored marble as indicated at 346. If a comparison occurs, the program retrieves data from the appropriate area in memory 162 to cause the phrase or word "CONGRATULATIONS" to be displayed as indicated at 348. If no comparison is found, the program accesses the appropriate area in memory to retrieve data causing display 114 to indicate "TRY AGAIN" as indicated at 350.

Thus, there has been disclosed a novel, inventive logic game including a simulated scale and simulated units to be weighed. There is a pictorial representation of a balance scale which can indicate visually whether or not the scale is balanced or unbalanced and, if unbalanced, the direction of the unbalance to the right or left. One of the marbles or units can be simulated to be heavier or lighter in weight than the remainder and the electronic circuitry coupled to the pictorial representation of the scale and the weight simulated to be heavier or lighter than the others causes appropriate visual indication of the change in balance of the scale. Thus the simulated unit which is heavier or lighter than the others may be detected logically by weighing a particular combination of the units a predetermined number of times.

It is understood that suitable modifications may be made in the structure as described and disclosed provided that such modifications come within the spirit and scope of the appended claims.

Having now, therefore, fully illustrated and described my invention, what I claim to be new and desire to protect by Letters Patent is:

1. An electronic logic game comprising:

a. a display having a first portion for representation of a balance scale and a second portion for representation of a plurality of units to be symbolically weighed, one of said units differing from the others electronically by one of two states, b. means for removing selected ones of said units from said second portion of said display to said first portion for display on said scale representation, c. means associated with said balance scale representation for detecting said different unit when it is visually displayed on said representation of said balance scale, and d. circuit weighing means coupled to said detecting means and said balance scale representation for visually representing said scale to be balanced or unbalanced in a predetermined direction according to said state of said different unit whereby said different unit may be logically discovered in a predetermined number of weighings by said electronic scale balance or unbalance representations.

2. An electronic game as in claim 1 wherein said representation of said electronic balance scale comprises:

(a) a right and left side of said scale, and (b) at least one indicator representing said scale tipped to the left, at least one indicator representing said scale tipped to the right, and at least one indicator representing said scale to be balanced.

3. An electronic game as in claim 2 wherein said indicators are lights.

4. An electronic logic game as in claim 3 further including:

a. means in said second portion of said display for visually displaying the units symbolically weighed during each of said scale balance or imbalance representation and the direction of said imbalance, and b. means coupled to said visual displaying means for retaining said visual display of said weighed units and the direction of imbalance whereby it can readily be ascertained which units were weighed and in which direction said scale was unbalanced during each of said weighings.

5. An electronic logic game comprising:

a. a first display area having means for representing a balance scale in its balanced state or either of its unbalanced states, b. a second display area having means for representing a plurality of playing units, and including manual selecting means for selectively simulating one of said units, to be heavier or lighter than the others, c. means for positioning selected ones of said playing units from said second area to said balance scale representation in said first area, and d. means coupled to said balance scale representating means for detecting the presence or absence of said one simulated heavier or lighter playing unit placed thereon and visually simulating said scale to be balanced or unbalanced in a predetermined direction according to the presence or absence of said one unit whereby said one unit may be logically discovered in a predetermined number of said electronic scale balance or unbalance representations.

6. An electronic logic game as in claim 5 wherein said means for pictorially representing a balance scale comprises an LCD display.

7. An electronic logic game as in claim 6 wherein said means for representing a balance scale includes a plurality of light emitting diodes, selected ones of which may be energized to pictorially represent said scale as balanced or unbalanced in either direction.

8. An electronic game as in 7 wherein said detecting means comprises:

a. a memory having a first portion for storing data representing said one of said playing units selectively simulated to be heavier or lighter than the others, b. said memory having a second portion for storing data representing said selected ones of said playing units which have been positioned on said scale in said first area of said display, and c. comparing means coupled to said first and second portions of said memory and said balance scale representation means for comparing said stored data and representing said scale to be balanced or unbalanced in accordance with said comparison.

9. An electronic game as in claim 8 further including:

(a) a keyboard, and (b) first means on said keyboard coupled to said first portion of said memory for selecting said one of said playing units and simulating it to be heavier or lighter than the others and storing said simulation in said first portion of said memory.

10. An electronic game as in claim 9 further including:

a. a second means on said keyboard coupled to said second portion of said memory and said second area of said display for selecting and displaying desired ones of said playing units on said simulated balance scale in said first area of said display, and b. third means on said keyboard coupled to said memory and said comparing means for causing a comparison to be made of said data representing said displayed playing units in said first area of said display and said data representing said stored playing unit which is simulated to be heavier or lighter than the others whereby said scale is balanced or unbalanced according to said comparison.

11. A method of solving a logic problem in an electronic logic game comprising the steps of:

a. forming a display having a first area with a visual representation of a scale that may be balanced or unbalanced and a second area with a visual representation of a plurality of playing units, b. selectively simulating one of said units to be heavier or lighter than the others, c. transferring a combination of selected ones of said plurality of playing units from said second area of said display to said scale representation in said first area to cause an indication of balance or imbalance of said scale representation and the direction of imbalance, and d. observing, and indicating said balance or imbalance when different combinations of said playing units from said second area are placed on said scale representation in said first area three successive times whereby said selected one of said playing units and its heavier or lighter simulated weight may be logically discovered.

* * * * *